US005813310A

United States Patent [19]

Hori et al.

[11] Patent Number: 5,813,310

[45] Date of Patent: Sep. 29, 1998

[54] WORKING MACHINE FALL PREVENTIVE VALVE APPARATUS

[75] Inventors: Shuji Hori; Tadao Karakama, both of Tochigi-ken, Japan

[73] Assignee: Komatsu, Ltd., Tokyo, Japan

[21] Appl. No.: 776,674

[22] PCT Filed: Aug. 3, 1995

[86] PCT No.: PCT/JP95/01545

§ 371 Date: Feb. 4, 1997

§ 102(e) Date: Feb. 4, 1997

[87] PCT Pub. No.: WO96/04431

PCT Pub. Date: Feb. 15, 1996

[30] Foreign Application Priority Data

Aug. 5, 1994 [JP] Japan ..... 6-184492

[51] Int. Cl.[6] ..... F15B 11/08

[52] U.S. Cl. ..... 91/446; 91/448; 91/451; 137/596.2

[58] Field of Search ..... 91/445, 446, 447, 91/448, 451; 137/596.2

[56] References Cited

U.S. PATENT DOCUMENTS

| | | | |
|---|---|---|---|
| 3,795,255 | 3/1974 | Malott et al. | 137/596.2 X |
| 3,929,159 | 12/1975 | McAvoy | 137/596.2 X |
| 4,716,933 | 1/1988 | Stoever et al. | 137/596.2 |
| 5,062,349 | 11/1991 | Khan | 91/436 |
| 5,372,060 | 12/1994 | Maruyama et al. | 91/446 X |
| 5,579,676 | 12/1996 | Wilke | 91/446 X |

FOREIGN PATENT DOCUMENTS

| | | |
|---|---|---|
| 32 39 930 | 5/1984 | Germany . |
| 57-22554 | 7/1955 | Japan . |
| 1-169105 | 7/1989 | Japan . |
| 3-73713 | 7/1991 | Japan . |

*Primary Examiner*—Hoang Nguyen
*Attorney, Agent, or Firm*—Wenderoth, Lind & Ponack, L.L.P.

[57] ABSTRACT

A working machine fall preventive valve apparatus is constructed with a cylinder side passage, a valve body, a check valve, a flow rate control valve, and a safety valve. The cylinder side passage is adapted to communicate with a cylinder port which is open to a cylinder side mounting surface. The valve body has a directional control valve side passage which is adapted to communicate with a directional control valve port. The check valve is provided in the valve body and prevents a pressure fluid from flowing into the directional control valve side passage from the cylinder side passage. The flow rate control valve provided in the valve body normally blocks communication between the directional control valve side passage and the cylinder side passage is responsive to an external signal for establishing the above mentioned communication. The safety valve is provided in the valve body and relieves a high pressure in the cylinder side passage. The check valve, the flow rate control valve and the safety valve are disposed in a plane that is substantially parallel to the cylinder side mounting surface.

20 Claims, 15 Drawing Sheets

WORKING MACHINE FALL PREVENTIVE VALVE APPARATUS

TECHNICAL FIELD

This invention relates to a working machine fall preventive valve apparatus. More particularly, the present invention relates to an apparatus which prevents the fall of any component of the working machine when a failure occurs in a hydraulic circuit for delivering a pressure fluid to a hydraulic cylinder for the operation of that working machine component. The working machine may be a construction machine such as a hydraulic excavating machine.

BACKGROUND ART

In general, a known hydraulic excavating machine has a construction in which a vehicle body has a boom mounted thereon by a boom cylinder so that the boom may be swung up and down. The boom, in turn, has an arm mounted thereto by an arm cylinder so that the arm may be swung up and down. In addition, the arm has a bucket swingingly secured thereto.

A hydraulic circuit delivers a pressure discharge fluid from a hydraulic pump to the respective cylinders in such a hydraulic excavating machine. The hydraulic circuit is provided in the discharge paths of the hydraulic pump with directional control valves for the boom, the arm and the bucket. Each directional control valve is switchingly operable to provide fluid communication between the respective control passages for controlling the fluid pressures corresponding to the boom cylinder, the arm cylinder and the bucket cylinder. The pump discharge paths on the other hand may selectively be established and blocked, thereby controlling an extending and a contracting operation of each such cylinder to control the behavior of each of the boom, the arm and the bucket.

With such a hydraulic circuit, each such cylinder is formed therein with a retention pressure producing chamber in which a retention pressure is developed in accordance with an external load such as the weight of the boom, the arm or the bucket. Such a retention pressure producing chamber is in fluid communication with a corresponding directional control valve via a fluid passage. Thus, when the corresponding directional control valve is set at a closed position, the chamber may act to maintain the fluid pressure between the chamber and the directional control valve and hence keep the corresponding boom, arm or bucket at a predetermined position. If the fluid passage connecting a given directional control valve and the corresponding retention pressure producing chamber is damaged while the boom, the arm or the bucket is held at a predetermined position, the pressure in the retention pressure producing chamber will decrease so that the cylinder may contact under an external load to cause the boom, the arm or the bucket supported thereby to immediately fall.

In order to prevent such a drop in the retention pressure within the retention pressure producing chamber under the operation of the hydraulic excavating machine, Japanese Unexamined Utility Model Publication No. Sho 5722554 has proposed an arrangement in which the fluid passage connecting a directional control valve and the retention pressure producing chamber of corresponding cylinder is provided with a working machine fall preventive valve apparatus. The apparatus, in turn, has a check valve, a flow rate control valve and a safety valve. In such an arrangement, when the fluid passage is damaged, the check valve will act to prevent a retention pressure from flowing out of the retention pressure producing chamber of the cylinder. Thus the boom will not fall due to the contraction of the cylinder under an external force.

The check valve is used to allow the operating fluid to flow from the directional control valve into the retention pressure producing chamber and to prevent the operating fluid from flowing out of the retention pressure producing chamber into the directional control valve. The flow rate control valve is held in a blocking state under a spring force. The flow rate control valve is brought to a communicating state in response to an external signal when the cylinder is contractively operated. Thus, the flow rate of the operating fluid from the retention pressure producing chamber into the directional control valve may be controlled based upon a command value of that external signal. When an impact force acts on the cylinder so that the pressure within the retention force producing chamber may abnormally be elevated, the safety valve will act to relieve the abnormally elevated pressure. Thus the latter will not damage the corresponding portion.

A mounting structure of a working machine fall preventive valve apparatus of this genre is disclosed in German Unexamined Patent Publication No. 3239930 (DE 3239930 Al). The disclosed working machine fall preventive valve apparatus provides a check valve, a flow rate control valve and a safety valve in a valve body that is mounted to a cylinder.

In the working machine fall preventive valve apparatus shown in German Unexamined Patent Publication No. 3239930, the valve body has a cylinder port that is open to a cylinder side mounting surface of the valve body. The safety valve is provided at the side of the cylinder side mounting surface. On the other hand, both the check valve and the flow rate control valve are provided at the side of a surface that is opposite the cylinder side mounting surface of the valve body. The distance measured from the mounting surface of the valve body to the opposing surface, i.e., the height of mounting the safety valve, the check valve and the flow rate control valve, is necessarily larger than the sum of the maximum diameter of the safety valve and the maximum diameter of the check valve and the flow rate control valve.

Accordingly, in the state in which the valve body of the working machine fall preventive valve apparatus has been mounted on the cylinder, the valve body projects from the cylinder surface on which it has been mounted. As a result, the swinging displacement of the cylinder relative to the cylinder mounted body may very likely cause the valve body to collide with the cylinder mounted body. The eventual result is therefore a reduced amount of the swinging displacement of the cylinder.

For example, with a hydraulic excavating machine as shown in FIG. 1, a boom cylinder 1 and a boom 2 are shown mounted on an upper vehicle body 3 at a pin 4 and at a pin 5, respectively. Thus, each body may be swingingly displaceable up and down. A valve body 7 of a working machine fall preventive valve apparatus 6 is shown mounted on the cylinder 1 at a location near pin 4. In such an arrangement, if the height H1 of mounting the valve body 7 is large, the valve body 7 will collide with the upper vehicle body 3 when the boom cylinder 1 is swingingly displaced upwards. Thus, the hydraulic exhaust machine requires a reduced amount of the up and down swinging displacement of the boom cylinder 1.

On the other hand, in order for the boom 2 to be swingingly displaced up and down to a large extent, the amount of the up and down swinging displacement of the boom cylinder 1 must necessarily be increased. In order to meet this demand, the prior art has adopted an arrangement in which the valve body 7 is mounted on the cylinder 1 at a location far from the pin 4. In addition, the cylinder port of the valve body and a port of the cylinder at the side of the fixed portion of a hydraulic circuit are connected together by means of a pipe line block or the like. Thus, if the cylinder 1 is swingingly displaced largely, the valve body 7 may not collide with the upper vehicle body 3. Since the valve body of the working machine fall preventive valve apparatus is then disposed spacedly from the pivotal point at the side of the pin 4, hydraulic piping structure, such as the pipe line block, becomes unduly complicated.

SUMMARY OF THE INVENTION

It is accordingly a principal object of the present invention to provide a working machine fall preventive valve apparatus whereby the above mentioned problems can be resolved.

A further and yet more specific object of the present invention is to provide a working machine fall preventive valve apparatus that can be assembled to reduce its mounting size relative to a hydraulic cylinder and so forth.

In order to achieve the above mentioned objects as well as other objects, there is provided in accordance with the present invention a working machine fall preventive valve apparatus having a cylinder side passage, a valve body, a check valve, a flow rate control valve, and a safety valve.

The cylinder side passage is adapted to communicate with a cylinder port which is open to a cylinder side mounting surface.

The valve body has a directional control valve side passage which is adapted to communicate with a directional control valve port.

The check valve is provided in the valve body and prevents a pressure fluid from flowing into the directional control valve side passage from the cylinder side passage.

The flow rate control valve is provided in the valve body to normally prevent communication between the directional control valve side passage and the cylinder side passage. In addition, the flow rate control valve is responsive to an external signal for establishing the communication.

The safety valve is provided in the valve body and relieves a pressure in the cylinder side passage.

Furthermore, the check valve, the flow rate control valve and the safety valve are disposed in a plane that is substantially parallel to the cylinder side mounting surface.

It should be noted that it is preferred that the flow rate control valve have a spool fittedly inserted in a spool bore so that it may be slidable therein between a communicating position and a blocking position. It is also preferable that the spool, when energized by a plurality of springs, may be held at the blocking position and that the spool, when under a pilot fluid pressure, may be thrusted to the communicating position. Finally, it is preferred that the springs are set so that when the pilot fluid pressure is low the spool will have an increased amount of displacement with respect to a change in the pilot pressure and when the pilot fluid pressure exceeds a given value the spool will have a reduced amount of displacement with respect to a change in the pilot pressure.

Also, it is possible that the flow rate control valve may have a spool fittedly inserted in a spool bore. Furthermore, the spool may be formed with a cone seat portion whereby communication between the directional control valve side passage and the cylinder side passage is blocked by the cone seat portion.

According to the above mentioned basic construction, it should be noted that by virtue of the fact that the check valve, the flow rate control valve and the safety valve are disposed in a plane that is substantially parallel to said cylinder side mounting surface, the height the valve body is made commensurate with a maximum diameter of the check valve, the flow rate control valve and the safety valve and accordingly is reduced.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

DESCRIPTION OF THE PREFERRED EMBODIMENTS

Figure 1:
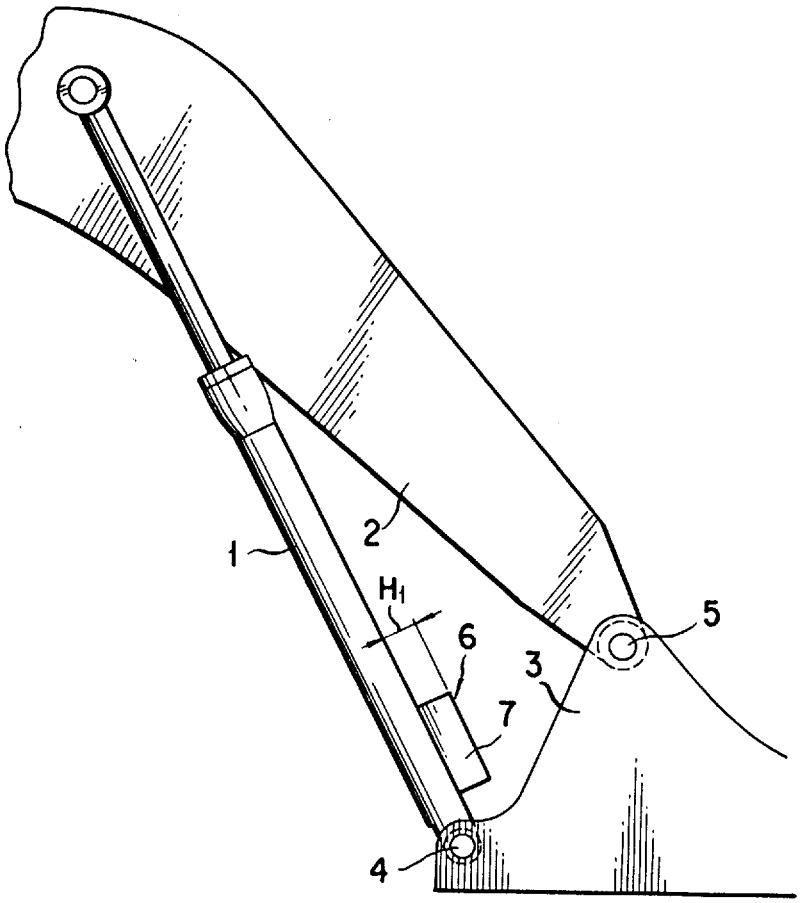
FIG. 1 is an explanatory view diagrammatically illustrating a state in which a conventional working machine fall preventive valve apparatus has been mounted on a cylinder.

Suitable embodiments of the present invention will now be set forth with reference to the accompanying drawings. In this connection, an explanation will be given of specific detailed constructions with respect to certain various parts in order to ensure a full understanding of the present invention. However, it will be apparent to a person skilled in the art that the present invention can be carried out without using such specific detailed constructions. Also, in order not to make the invention unclear, a detailed explanation will be omitted with respect to any known construction.

As shown in FIGS. 2 to 6, a valve body 10 is formed as a rectangular solid having a cylinder side mounting surface 11 and an opposite side surface 12. In addition, valve body 10 has opposing first 13 and second 14 surfaces and opposing third 15 and a fourth 16 surfaces. The third surface 15 of the valve body 10 is formed with a directional control valve port 17. The valve body 10 is formed with a directional control valve side passage 18 that communicates with the directional control valve port 17. The cylinder side mounting surface 11 of the valve body 10 is formed with a cylinder port 19 which is designed to communicate with a cylinder side passage 20 that is formed in the valve body 10.

The directional control valve side passage 18 and the cylinder side passage 20 are formed on a plane that is parallel to the cylinder side mounting surface 11, and are designed to communicate with each other via a communicating bore 21. The communicating bore 21 is adapted to open and close by means of a valve 22. The valve 22 is energized by a spring 23 in a direction which normally closes the communicating bore. A check valve 24 is formed by the valve 22 and the communicating bore 21. The check valve 24 allows an operating fluid to flow from the directional control valve side passage 18 into the cylinder side passage 20 and also prevents the operating fluid from reversely flowing into the directional control valve side passage 18 from the cylinder side passage 20.

The valve body 10 has a spool bore 25 formed therein which is open to both the first surface 13 and the second surface 14. In addition, the spool bore is adapted to place the directional control valve side passage 18 in connection with the cylinder side passage 20. The spool bore 25 has a spool 26 slidably inserted therein.

The spool 26 is formed with a first small diameter portion 27 at a position corresponding to the directional control valve side passage 18 and with a second small diameter portion 28 at a position corresponding to the cylinder side passage 20. A large diameter portion 29 lies between the first and second small diameter portions 27 and 28, respectively. The spool 26 is thrusted by a first spring 30 and a second spring 31 leftwards in FIG. 2 so that its one end surface may abut on a plug 32. The spool 26 is then held at a position to block communication between the directional control valve side passage 18 and the cylinder side passage 20. A pilot pressure acts on the one end surface of the spool 26, which is a pressure receiving portion 33, to energize the spool 26 rightwards in FIG. 2 against the energizing forces of the first and second springs 30 and 31. Thus, if the pilot pressure acting on the pressure receiving portion overcomes the spring forces of the first and second springs 30 and 31, the spool 26 will be displaced rightwards in FIG. 2 to a position where the second small diameter portion 28 is aligned with both the directional control valve side passage 18 and the cylinder side passage 20 thus allowing communication between these two passages. The rate of flow of the operating fluid flowing between the directional control valve passage 18 and the cylinder side passage 20, which are in communication with each other via the second small diameter portion 28 of the spool 26, will vary in accordance with the area of the opening between the second small diameter portion 28 and the directional control valve side passage 18. This area varies in accordance with the amount of displacement of the spool 26 in the rightward direction in FIG. 2. Therefore a flow control valve 34 is constituted by the spool bore 25 and the spool 26.

Figure 2:
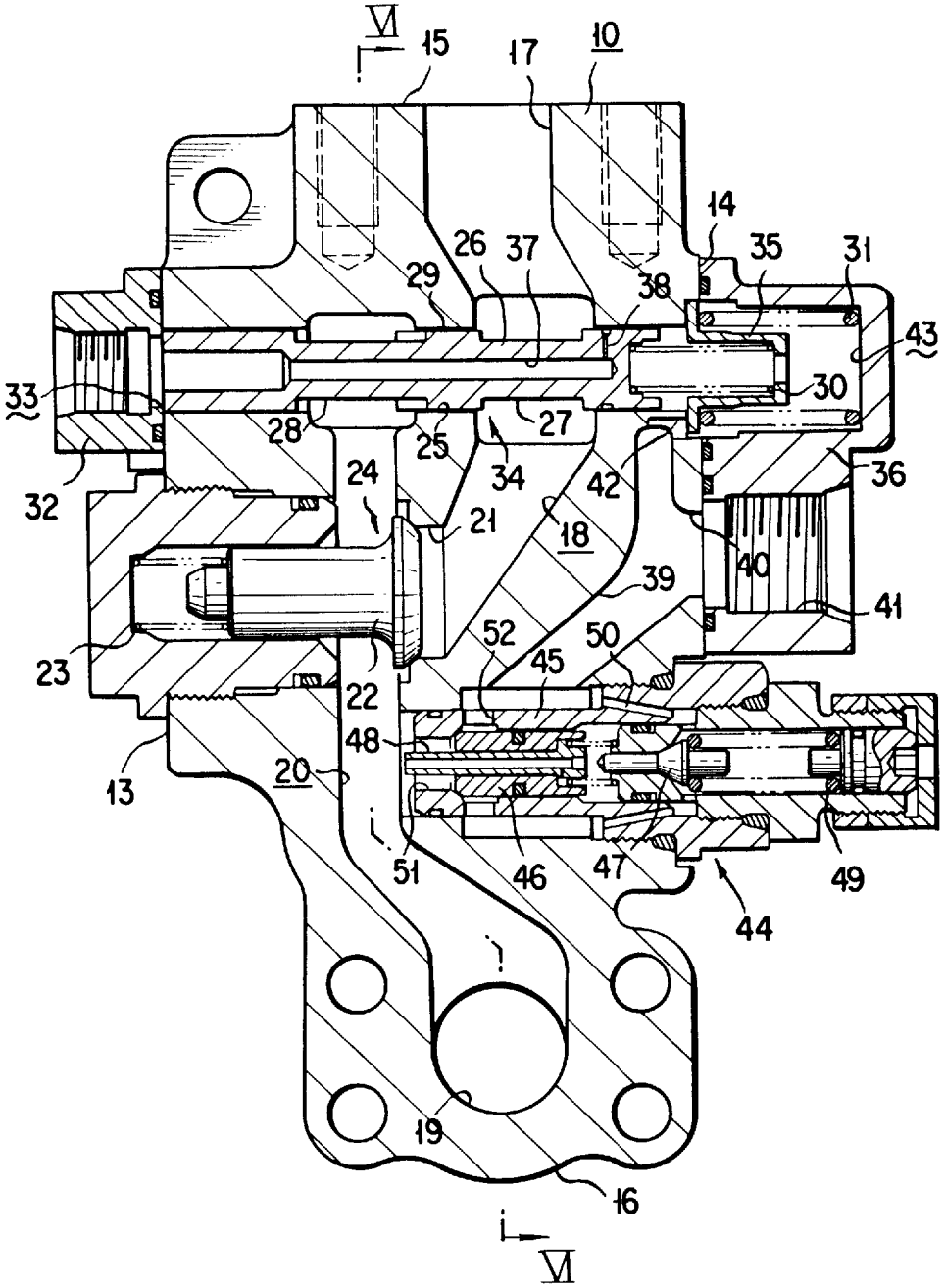
FIG. 2 is a transverse cross sectional view of a working machine fall preventive valve apparatus according to a first embodiment of the present invention.

As shown in FIG. 2, the first spring 30 is interposed between the other end surface of the spool 26 and a movable spring bearing 35. The second bearing 31 is interposed between the movable spring bearing 35 and a fixed spring box 36. The fixed spring box 36 is bolted to the second surface 14 of the valve body 10. Note that the spring force of the first spring 30 is lower than the spring force of the second spring 31.

In a construction as mentioned above, if a pilot pressure is applied to the pressure receiving portion 33 from a pilot pipe line (see FIG. 8) connected to the plug 32, the spool 26 will be displaced rightwards against the first spring 30. The amount of displacement of the spool is proportional to the magnitude of the pilot pressure. If the amount of displacement of the spool 26 exceeds a predetermined value, the other end surface will abut against the movable spring bearing 35. At the position of displacement when the spool 26 abuts against the movable spring bearing 35, the large diameter portion 29 of the spool 26 will still remain in engagement with the peripheral wall of the spool bore 25 so as to hold the blocking state between the directional control valve side passage 18 and the cylinder side passage 20. As will be set out later, the pilot pressure is a control pressure that is produced when the cylinder is contractively operated to discharge the fluid pressure out of the cylinder side passage 20 into the directional control valve side passage 18.

If the pilot pressure is further elevated from the above mentioned state, the spool 26 will be thrusted rightwards against the said second spring 31. Consequently, the large diameter portion 29 will exit the spool bore 25 thus allowing the small diameter portion 28 to facilitate communication between the directional control valve side passage 18 and the cylinder side passage 20. At this time, the area of the opening between the second small diameter portion 28 and to the directional control valve side passage 18 will be increased in proportion to the pilot pressure as mentioned above.

Figure 7:
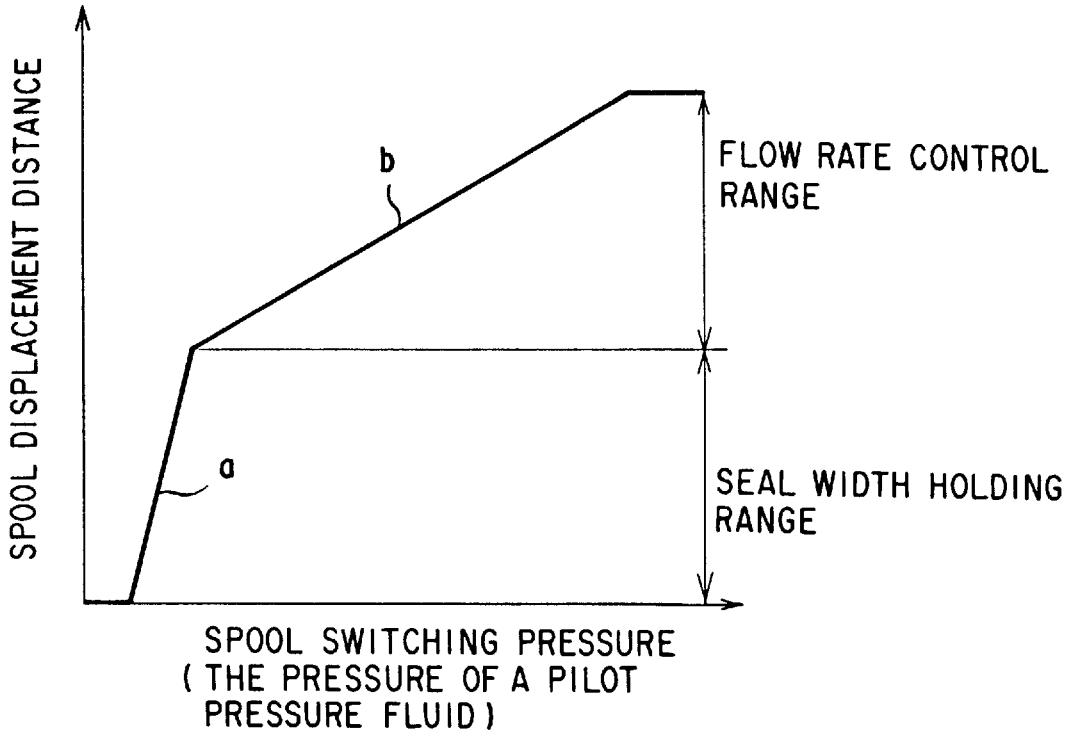
FIG. 7 is a graph showing a relationship between a distance of displacement of a spool of a flow rate control valve and a pressure of a pilot pressure fluid.

Stated in other words, the displacement of the spool, with respect to a change in the pilot pressure can be characterized, as shown in FIG. 7, as two stepped lines having a portion a in which the spool 26 is displaced against the first spring 30 and a portion b in which it is displaced against the second spring 31. In the spool displacement characteristic shown in FIG. 7, the portion a represents a seal width holding range while the portion b represents a flow rate control range. For the reason that the seal width (i.e., the length of fitted insertion of the large diameter portion 29 in the spool bore 25), when the pilot pressure is not active, is relatively large it is possible to minimize the fluid leakage. Also, in the portion a in which the first spring 30 acts in opposition to the pilot pressure, the capability to set the spring force of the first spring 30 to be relatively small will allow the amount of displacement of the spool 26 to be increased relative to a pressure fluctuation of the pilot pressure. On the other hand, in the portion b in which the spring 31 having a relatively large spring force acts in opposition to the pilot pressure, the amount of displacement of the spool 26 will be reduced relative to a pressure fluctuation of the pilot pressure. Thus, since the length of fitted insertion of the large diameter portion 29 of the spool 26 in the spool bore 25 may be increased without largely increasing the entire spool displacement distance, it is possible to reduce the amount of leakage of the operating fluid in a small gap between the spool bore 25 and the spool 26 as well as control the flow rate at a high precision in the portion b.

As shown in FIG. 2, the spool 26 is formed with a blind hole 37 in its axial direction and a bore 38 in its radial direction. With such an arrangement, when the spool 26 is incorporated in the valve body 10, air may be extracted from the pilot pipe line by thrusting the spool 26 rightwards to allow the bore 38 to open into the fixed spring box 36. More specifically, such an air extraction in the pilot pipe line is possible because the valve body 10 is formed with a tank passage 39 which communicates through a tank port with a tank side port 41 of the fixed spring box 36. Next, the tank passage 39 opens through a communicating port 42 to a spring reception chamber 43 of the fixed spring box 36. Air is extracted when the pressure receiving portion 33 and the interior of the plug 32 are placed in communication with the tank side port 41 by thrusting the spool 26 rightwards to cause the bore 38 to be open to the spring reception chamber 43.

The valve body 10 is further provided with a safety valve 44. Thus, when the fluid pressure within the said cylinder side passage 20 exceeds a relief pressure, an excessive pressure may be relieved into the tank passage 39. The main elements of the safety valve 44 include a sleeve 45, a main valve 46, an auxiliary valve 47, a pipe 48. The fluid pressure within the cylinder side passage 20 acts on the auxiliary valve 47 through the pipe 48. When the fluid pressure introduced from the cylinder side passage exceeds a value commensurate with the mounting weight of the spring 49, the auxiliary valve 47 will, in opposition to the spring force of the spring 49, open an auxiliary flowout port 50. As a result, the operating fluid introduced from the cylinder side passage 20 will to flow into the tank passage 39. A differential pressure will thereby be produced around the main valve 46 to open both a main inlet port 51 and a main flowout port 52 so that the fluid pressure of the cylinder side passage 20 may be relieved into the tank passage 39.

Figure 8:
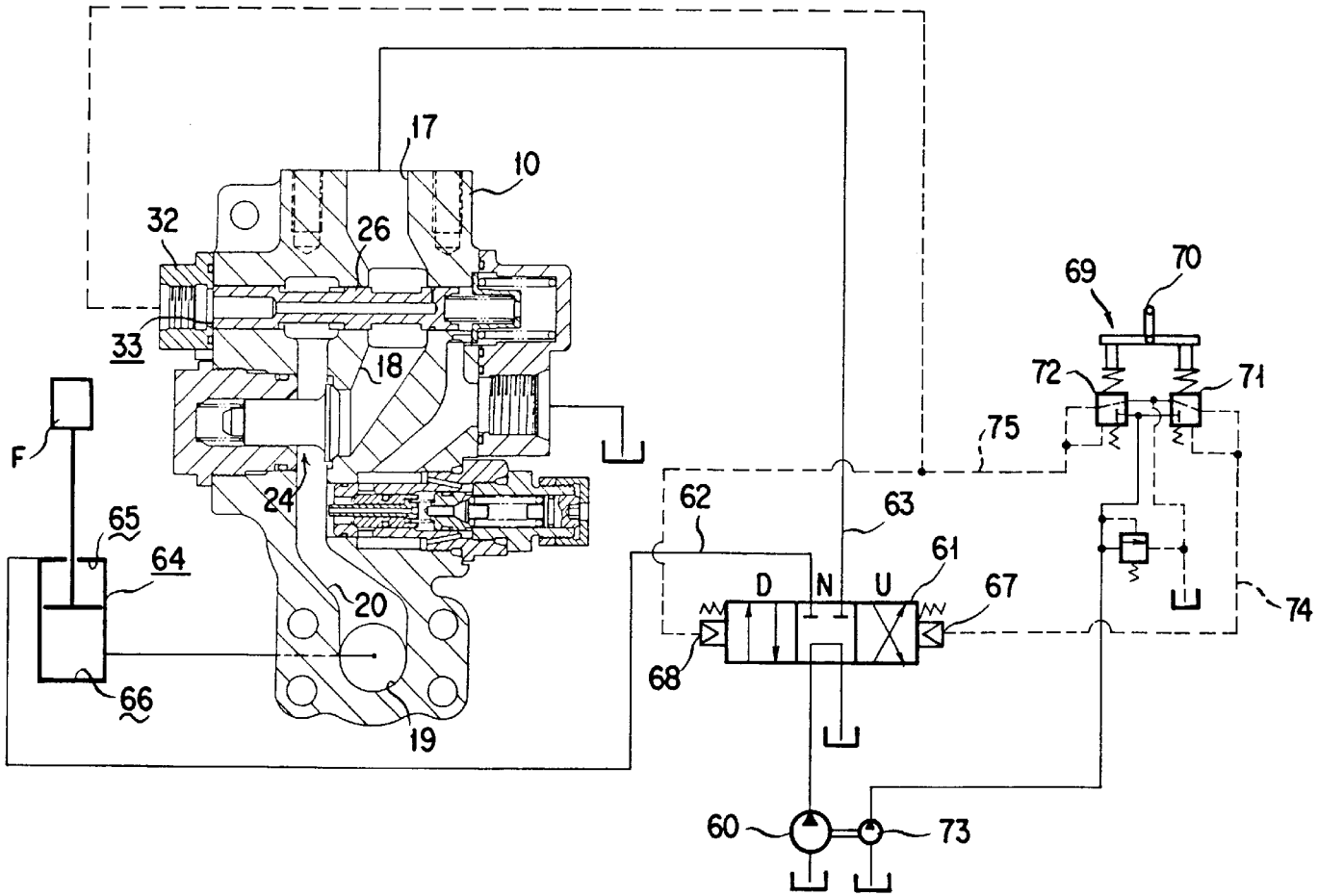
FIG. 8 is a hydraulic circuit diagram showing the state in which the fall preventive valve apparatus according to a first embodiment of the present invention is incorporated into a hydraulic circuit.

As shown in FIG. 8, the discharge pressure fluid will be delivered to a first pipe conduit 62 and a second pipe conduit 63 through a directional control valve 61. The first pipe conduit 62 is connected to the lowering side chamber 65 of a cylinder 64 whereas the second pipe conduit 63 is connected to the directional control valve port 17 of the valve body 10. Also, the cylinder port 19 of the valve body 10 is connected to the elevating side chamber (i.e., the retention pressure producing chamber) of the said cylinder 64.

The above mentioned directional control valve 61 has a neutral position N an elevating position U and a lowering position D and is normally held at the neutral position N. The directional control valve 61 is switched to the elevating position U by the pressure fluid supplied to a first pressure receiving portion 67 and to the lowering position D by the pressure fluid supplied to a second pressure receiving portion 68. It should be noted that a pilot pressure is applied through a pilot valve 69 to the first and second pressure receiving portions 67 and 68.

Figure 3:
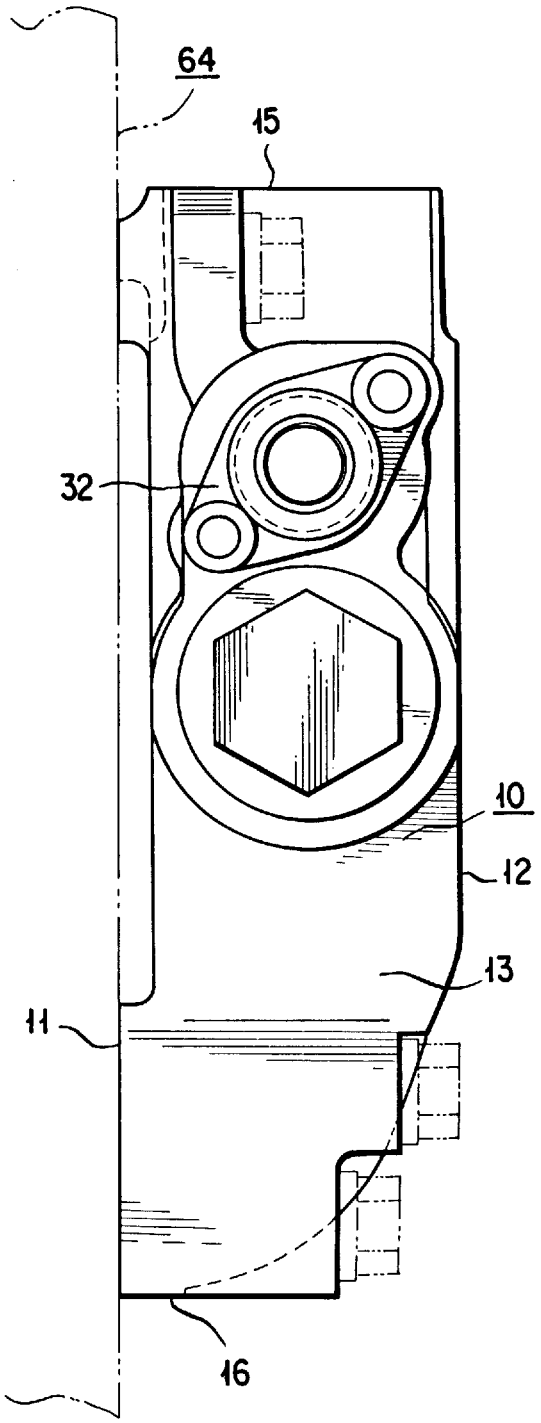
FIG. 3 is a left hand side view of the fall preventive valve apparatus of FIG. 2.
Figure 4:
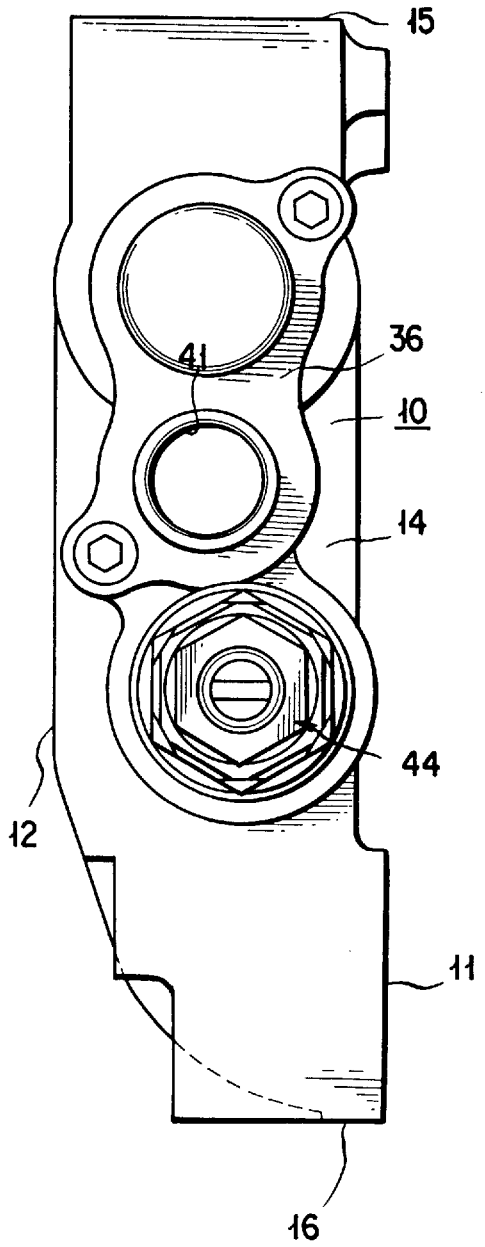
FIG. 4 is a right hand side view of the fall preventive valve apparatus of FIG. 2.
Figure 5:
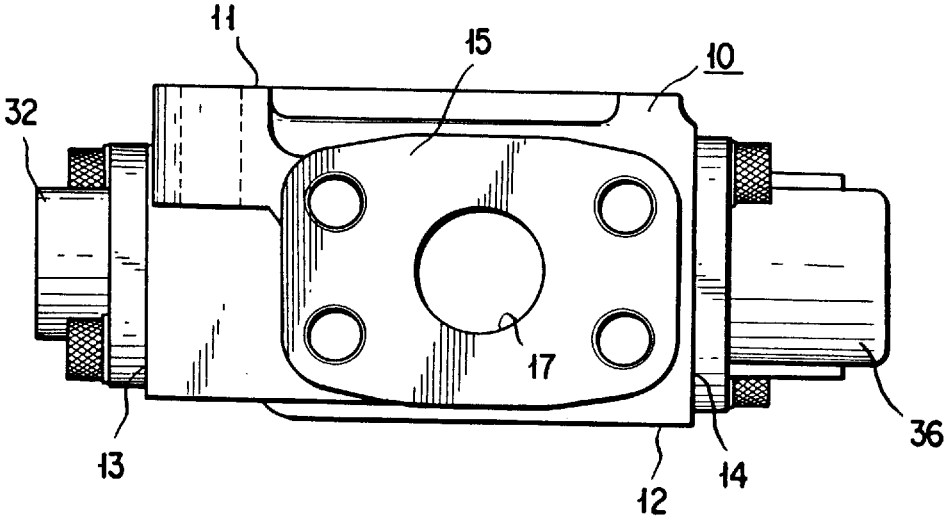
FIG. 5 is a top plan view of the working machine fall preventive valve apparatus of FIG. 2.
Figure 6:
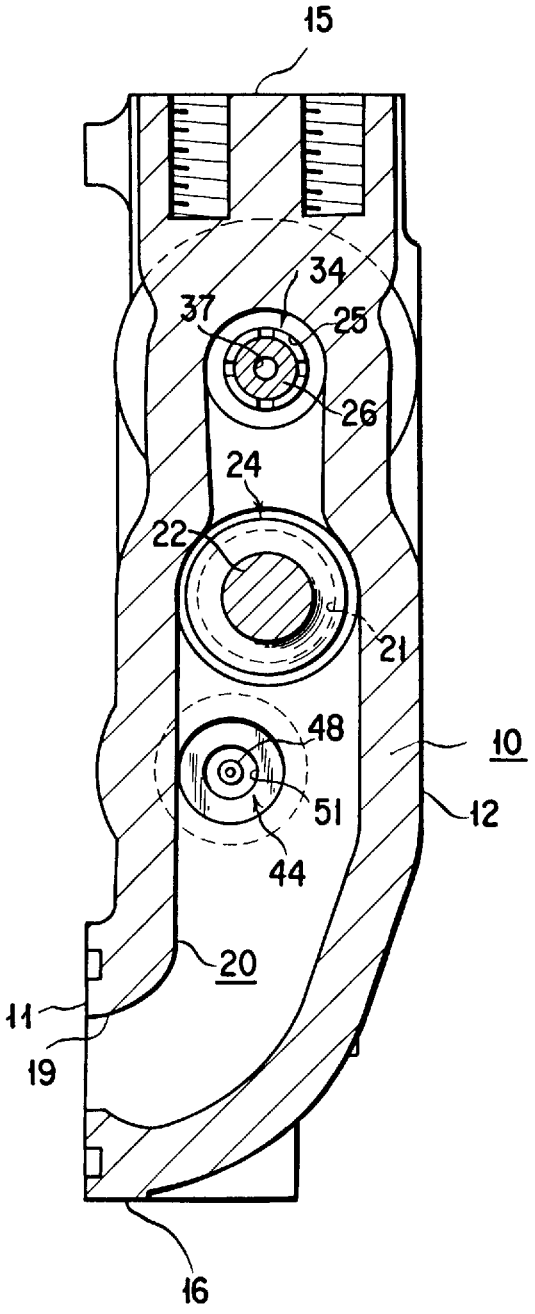
FIG. 6 is a cross sectional view taken along the line VI—VI in FIG. 2.

The pilot valve 69 is provided with a first and a second reduced pressure valve portion 71 and 72 that can be operated with an operating lever 70. An auxiliary hydraulic pump 73 supplies pressure fluid to the first and second reduced pressure valve portions 71 and 72 through their respective inlet sides. The first and second reduced pressure valves 71 and 72 are connected to the first and second pressure receiving portions 67 and 68 of the directional control valve 61 by a first and a second pilot pipe conduit, 74 and 75, respectively. The second pilot pipe conduit 75 is also connected to the plug 32 of the valve body 10. Specifically, the cylinder side mounting surface 11 of the valve body 10 is, as shown in FIGS. 3 and 6, bolted to the cylinder 64 so that the cylinder port 19 may directly communicate with the port of the cylinder.

An explanation will now be given with respect to the operation of the apparatus described.

The pressure fluid within the elevating side chamber 66 of the cylinder 64 is allowed to flow into the cylinder side passage 20 from the cylinder port 19, but is prevented by the check valve 24 from flowing into the directional control side passage 18. Accordingly, if the second pipe conduit 63 connected to the directional control valve port 17 is damaged, the retention pressure produced in the elevating side chamber 66, in accordance with an external load F will not flow out of the second pipe conduit. Therefore the boom, the arm or the bucket, in a hydraulic excavating machine, will be prevented from falling suddenly.

If a pilot pressure fluid is supplied to the first pilot pipe conduit 74 by operating the first reduced pressure valve 71 with the operating lever 70, the directional control valve 61 will assume the elevating position U. Then, the discharge pressure fluid from the hydraulic pump 60 will flow into the directional control valve port 17 from the second pipe conduit 63. Next, the discharge pressure fluid will open the check valve 24 and then flow into the elevating side chamber 66 of the cylinder 24 from the cylinder port 19. Thus, the pressure fluid within the lowering side chamber 65 will be discharged through the first pipe conduit 62 and the directional control valve 61 into a reservoir.

If a pilot pressure fluid is supplied to the second pilot pipe conduit 75 by operating the second reduced pressure valve 72 with the operating lever 70, the directional control valve 61 will assume the lowering position D. Then, the discharge pressure fluid from the hydraulic pump 60 will be delivered to the lowering chamber 65 of the cylinder 64.

At the same time, a pilot pressure fluid will be delivered from the plug 32 of the valve body 10 to the pressure receiving portion 33 to thrust the spool 26 rightwards. Thus, the directional control valve side passage 18 and the cylinder side passage 20 are placed in connection with each other. Then, the pressure fluid within the elevating side chamber 66 of the cylinder 64 will be allowed to flow through the cylinder port 19 and the cylinder side passage 20 into the directional control valve side passage 18. Finally, the pressure fluid will be discharged through the directional control valve port 17 and the directional control valve 61 into the reservoir.

Figure 9:
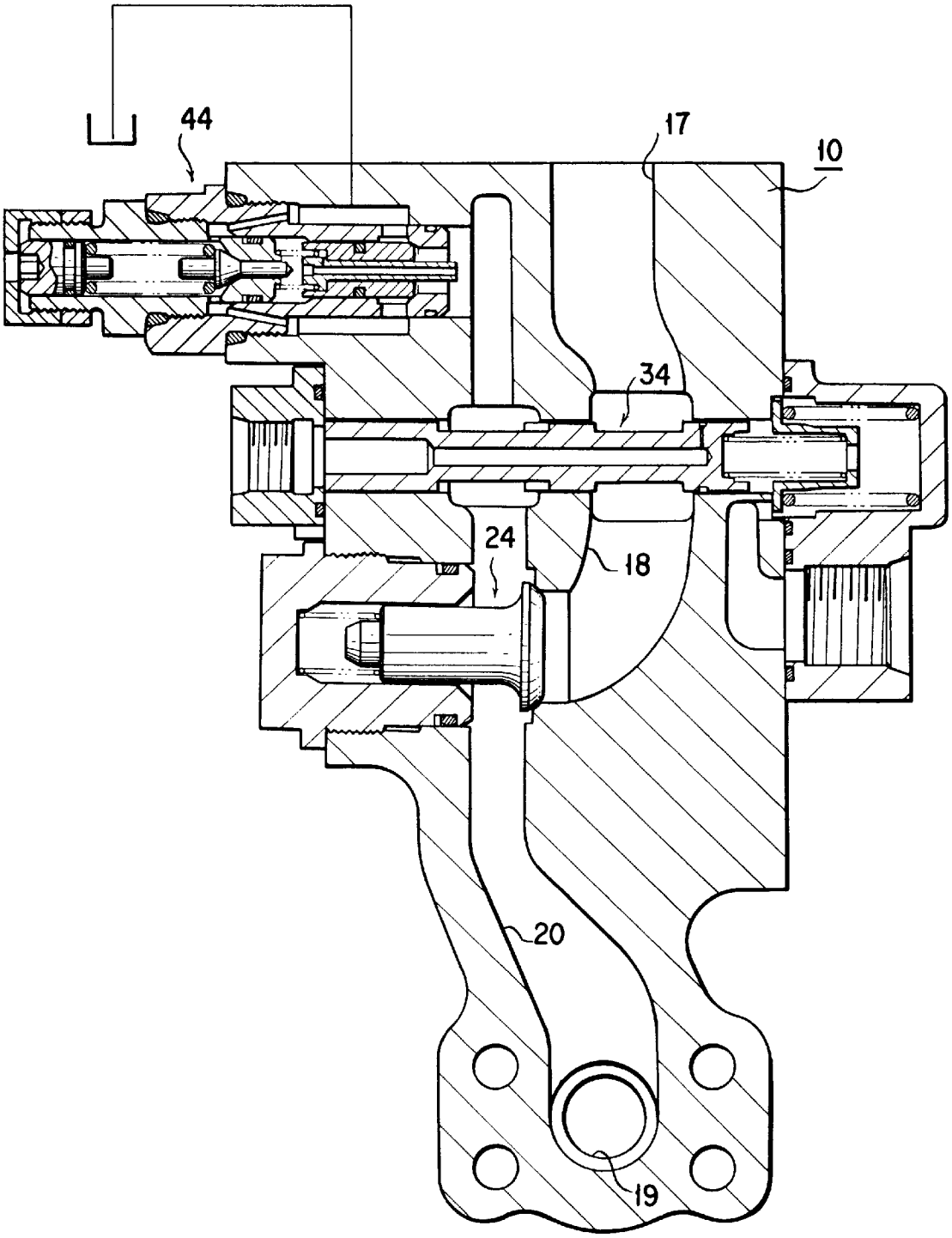
FIG. 9 is a transverse cross sectional view of a working machine fall preventive valve apparatus according to a second embodiment of the present invention.

FIG. 9 shows a working machine fall preventive valve apparatus with a hydraulic circuit according to the second embodiment of the present invention. In the present embodiment, the safety valve 44 is disposed at a position that is closer to the directional control valve port 17 than the flow rate control valve 34 in the valve body 10.

Figure 10:
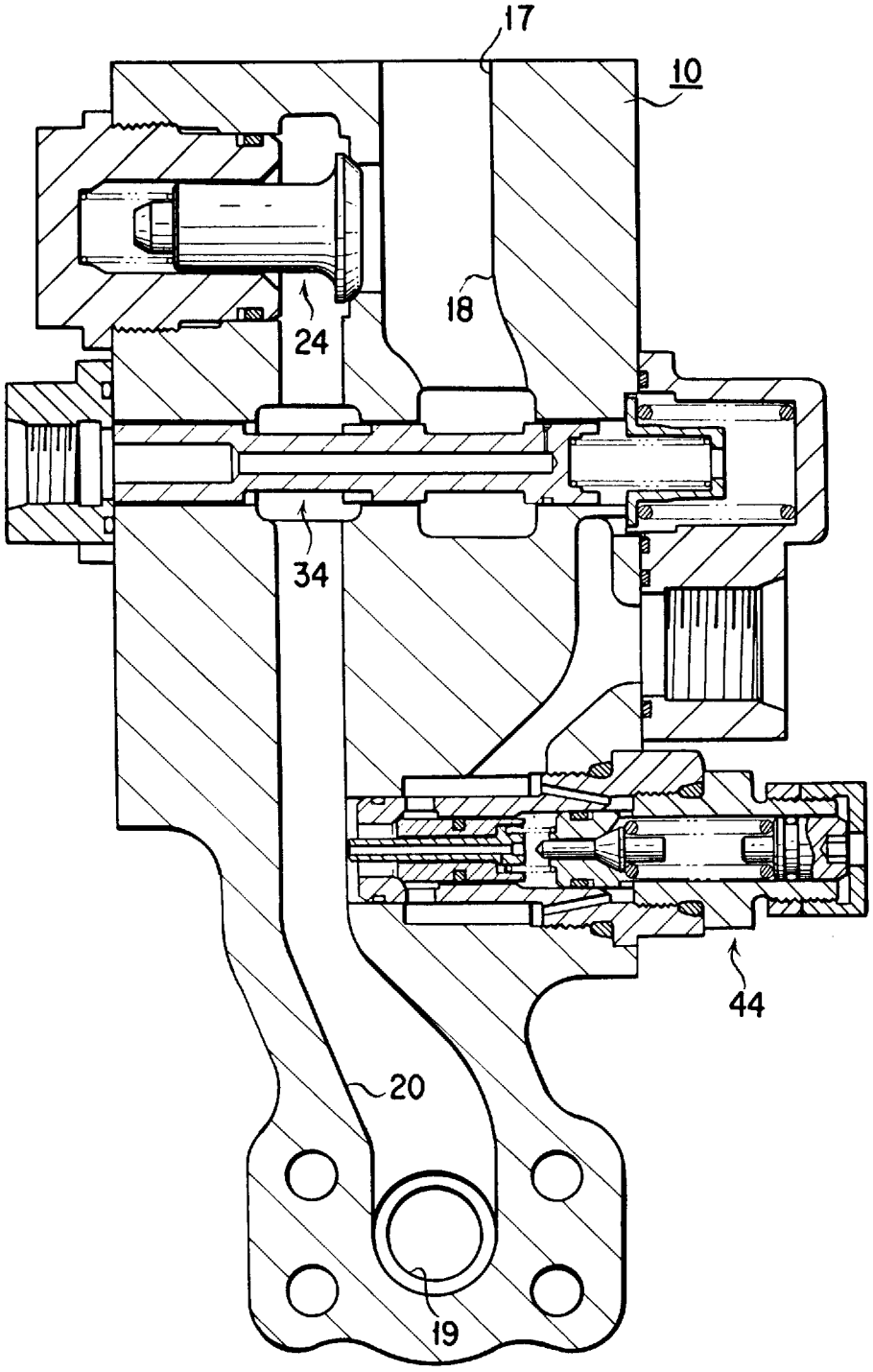
FIG. 10 is a transverse cross sectional view of a working machine fall preventive valve apparatus according to a third embodiment of the present invention.

FIG. 10 shows a working machine fall preventive valve apparatus with a hydraulic circuit according to the third embodiment of the present invention. In the present embodiment, the check valve 24 is disposed at a position that is closer to the directional control valve part 17 than the flow rate control valve 34 in the valve body 10.

Figure 11:
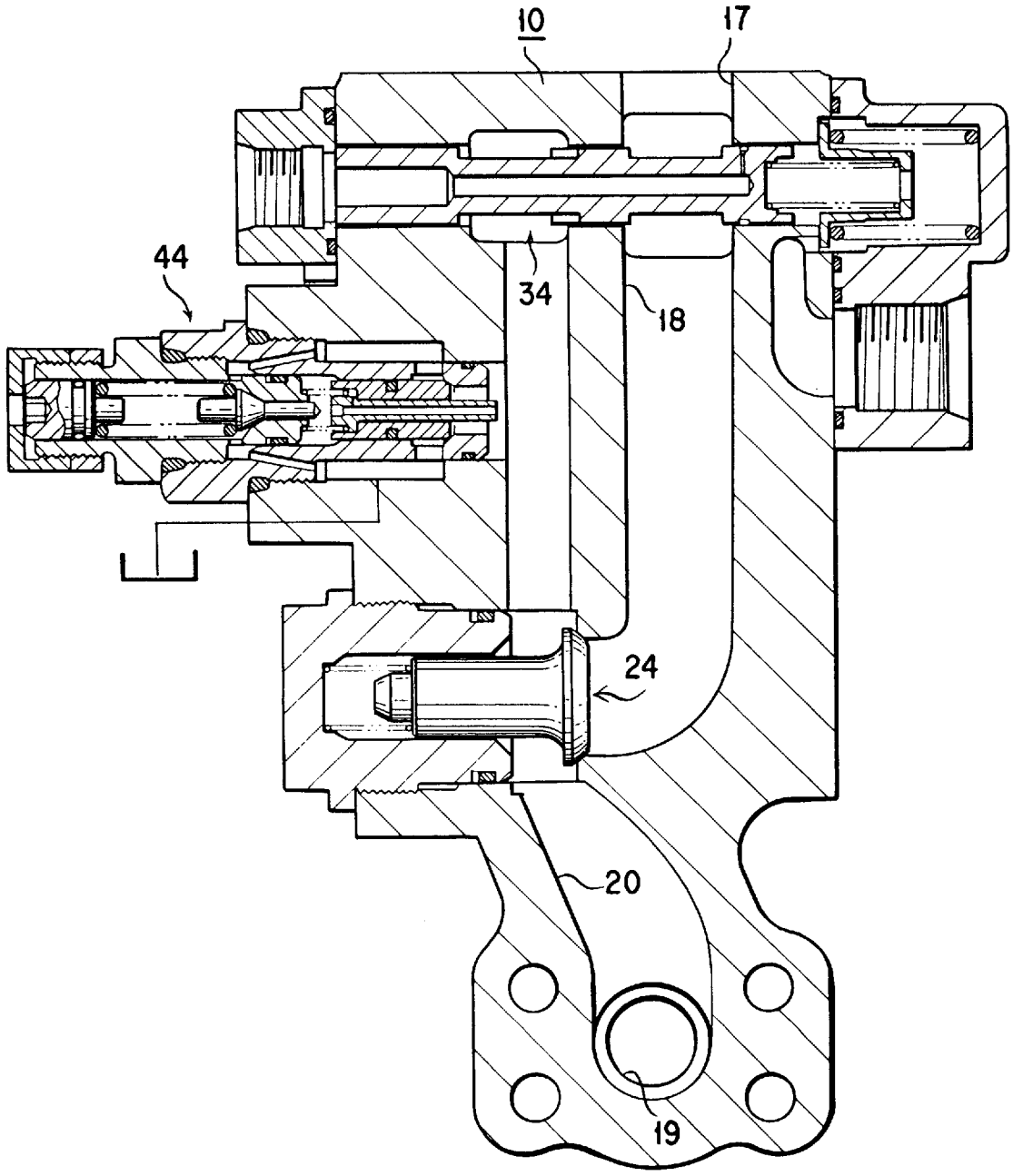
FIG. 11 is a transverse cross sectional view of a working machine fall preventive valve apparatus according to a fourth embodiment of the present invention.

FIG. 11 shows a working machine fall preventive valve apparatus with a hydraulic circuit according to the fourth embodiment of the present invention. In the present embodiment, the check valve 24 is disposed at a position that is closer to the cylinder port 19 than the flow rate control valve 34 in the valve body 10. In addition, a safety valve 44 is disposed between the check valve 24 and the flow rate control valve 34.

Figure 12:
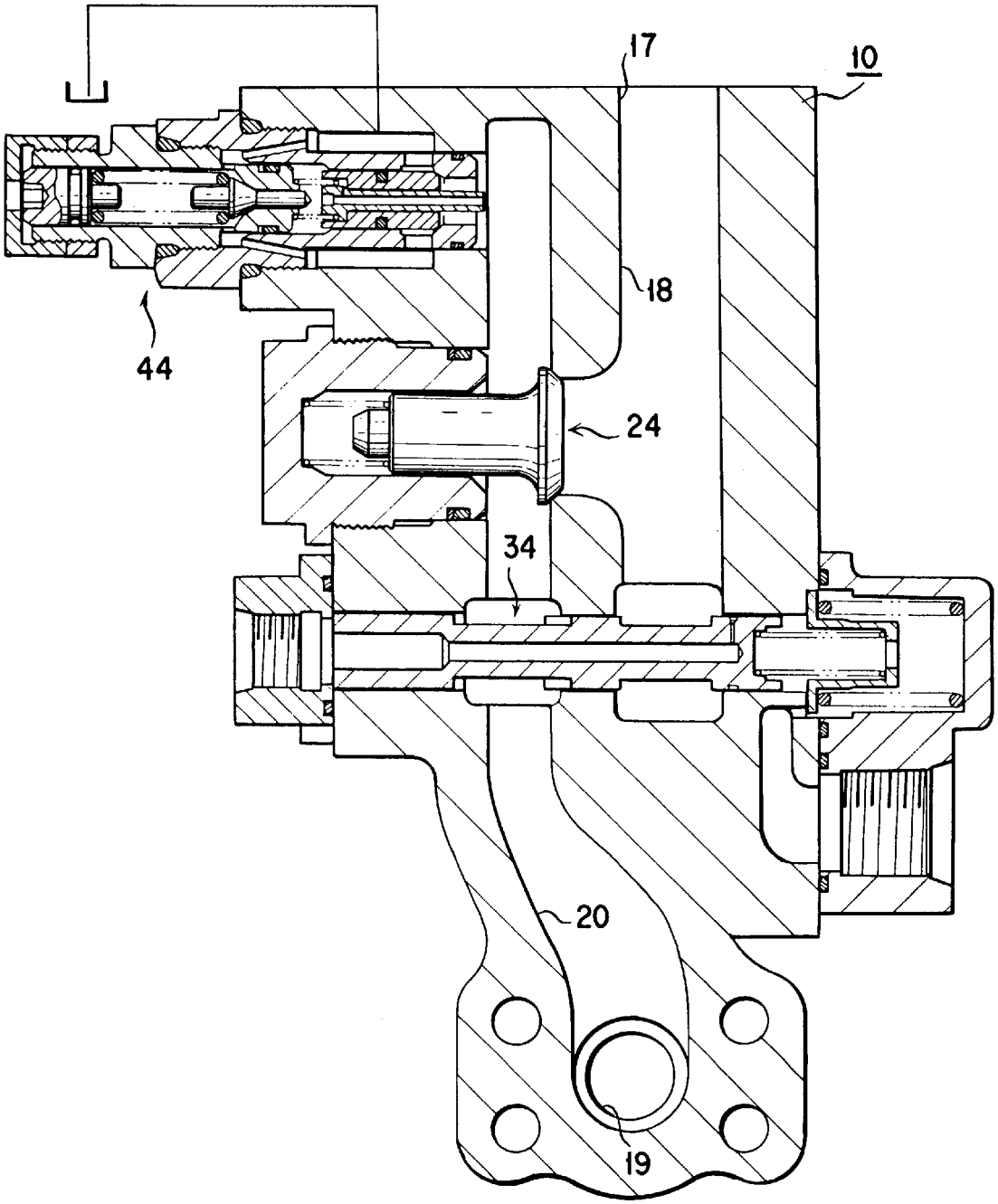
FIG. 12 is a transverse cross sectional view of a working machine fall preventive valve apparatus according to a fifth embodiment of the present invention.

FIG. 12 shows a working machine fall preventive valve apparatus with a hydraulic circuit according to the fifth embodiment of the present invention. In the present embodiment, the safety valve 44 is disposed at a position that is closer to the flow rate control valve port 17 in the valve body 10. In addition, the check valve 24 is disposed between the safety valve 44 and the flow rate control valve 34.

Figure 13:
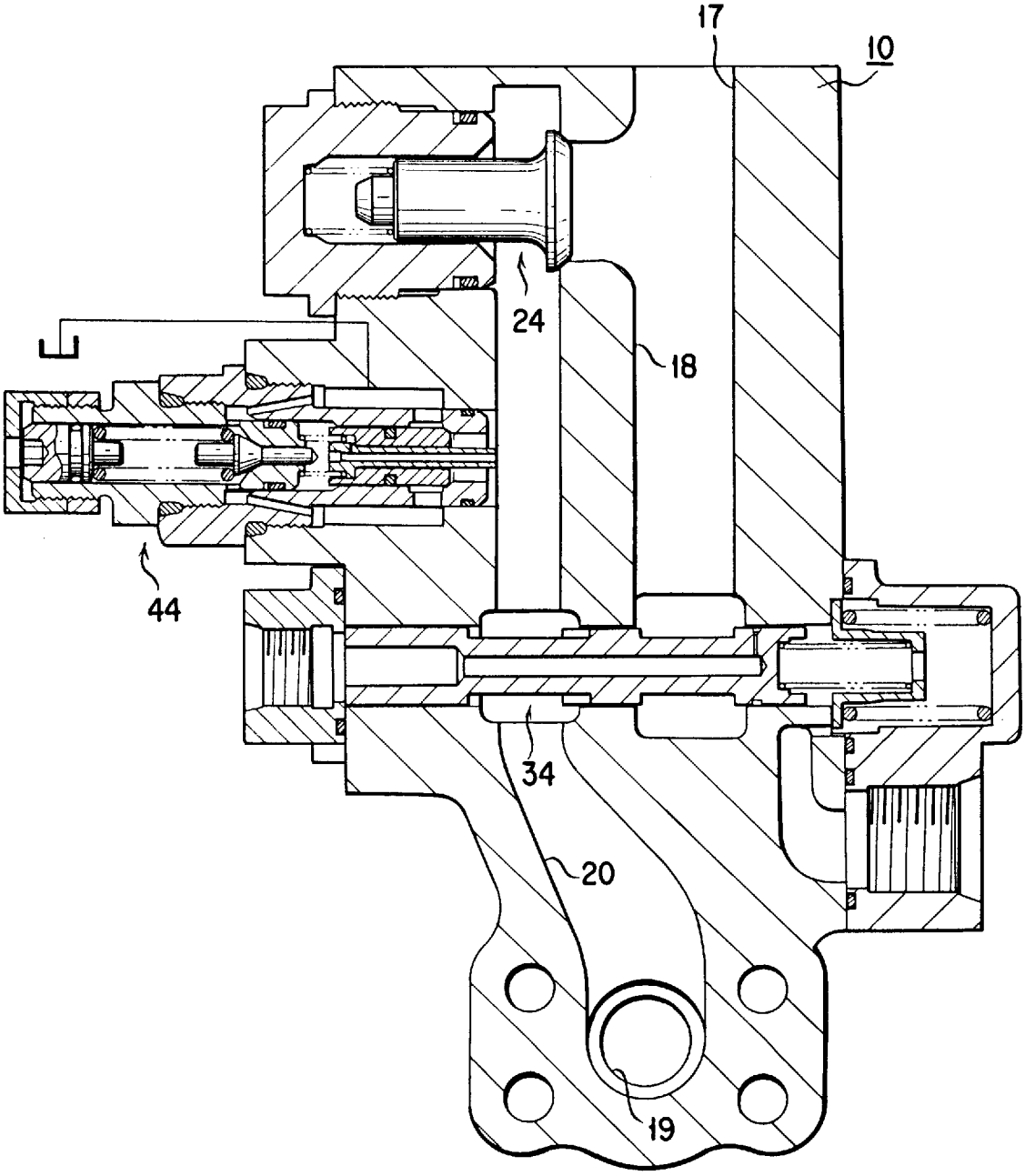
FIG. 13 is a transverse cross sectional view of a working machine fall preventive valve apparatus according to a sixth embodiment of the present invention.

FIG. 13 shows a working machine fall preventive valve apparatus with a hydraulic circuit according to the sixth embodiment of the present invention. In the present embodiment, the check valve 24 is disposed at a position that is closer to the directional control valve port 17 in the valve body 10. In addition, the safety valve 44 is disposed between the check valve 24 and the flow rate control valve 34.

Figure 14:
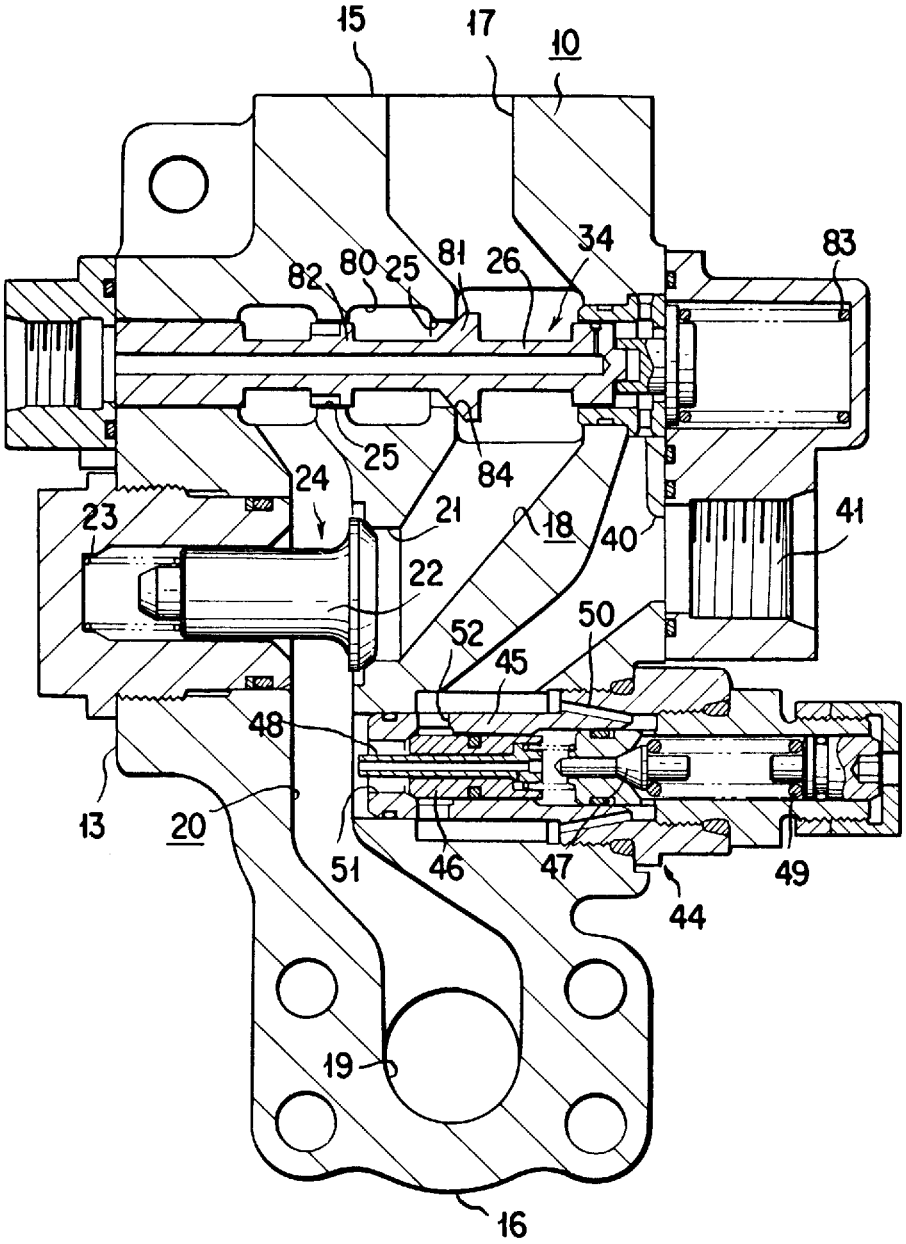
FIG. 14 is a transverse cross sectional view of a working machine fall preventive valve apparatus according to a seventh embodiment of the present invention.

In the foregoing various embodiments, the check valve 24, the flow rate control valve 34 and the safety valve 44 are variously arranged. In the seventh embodiment shown in FIG. 14, the arrangement of these valves is similar to that in FIG. 12, but the flow rate control valve 34 is differently constructed.

More specifically, the valve body 10 is formed with an intermediate port 80 that is open to the spool 25. On the other hand, the spool 26 is formed with a cone seat portion of conical configuration and a large diameter portion 82 to be opened and closed. The spool 26 is designed to be energized by a spring 83 so as to be thrusted leftwards. The cone seat portion 81 is adapted to abut against a peripheral portion 84 that is open to the directional control valve side passage 18 of the spool 26. Thus, communication between the directional control valve side passage 18 and the intermediate port 80 may be blocked. At this instance, communication between the intermediate port 80 and the cylinder side passage 20 is also blocked.

In such a construction as mentioned above, since the abutting section of the cone seat portion 81 and the peripheral portion 84 blocks communication between the directional control valve side passage 18 and the cylinder side passage 20, there will be no fluid leakage from that section. In addition, not only will there be no leakage of the retention pressure of the cylinder towards the directional control valve side passage 18 but also the fact that a single spring is utilized makes the structure simpler than the embodiment shown in FIG. 2.

Figure 15:
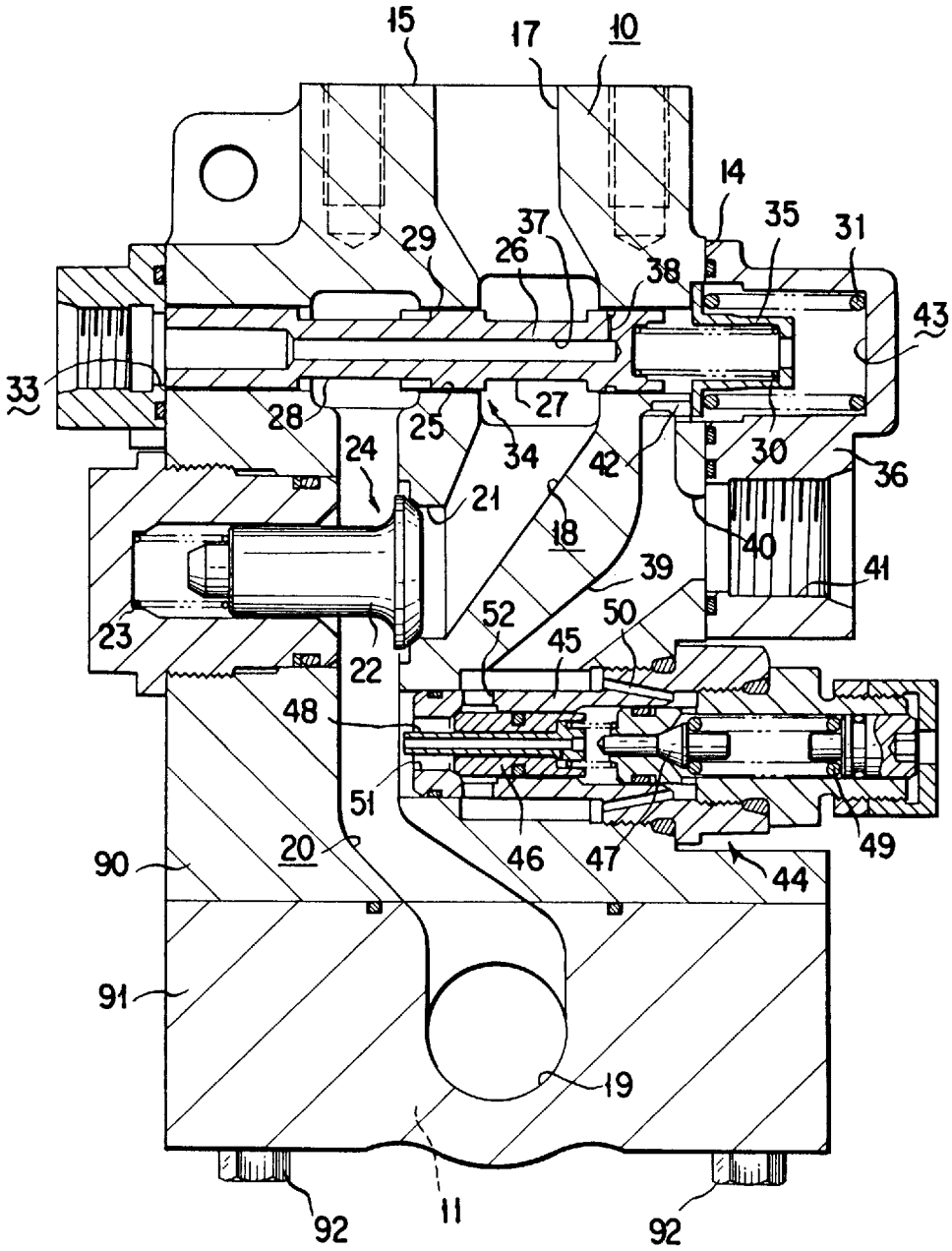
FIG. 15 is a transverse cross sectional view of a working machine fall preventive valve apparatus according to an eighth embodiment of the present invention.

While the valve body 10 is shown as being a single integral unit in the previous embodiments it is also possible to adopt an arrangement, as in the eighth embodiment shown in FIG. 15, in which a first valve body 90, having mounted thereon the check valve 24, the flow rate control valve 34 and the safety valve 44, is connected by bolts 92 to a second valve body 91, having the cylinder port 19 that is open to the cylinder side mounting surface 11 to form a modified valve body 10.

According to the present invention, as set forth in the foregoing, it can be seen that by virtue of the fact that a check valve 24, a flow rate control valve 34 and a safety valve 44 are located on an identical level, the height of a valve body 10, after mounting, is set at a value that is commensurate with the largest diameter of the check valve 24, the flow rate control valve 34 and the safety valve 44. Owing to this fact, the height of the valve body 10, after mounting, is reduced. Thus, if a cylinder is swingingly displaced to a large extent relative to the cylinder mounted body, the valve body will not collide with the cylinder mounted body. Accordingly, by simply mounting the valve body 10 on a cylinder, it follows that it is possible to increase the amount of the swinging displacement of the cylinder as well as simplify the entire structure of the apparatus and its mounting operation.

Also, the flow rate control valve 34 is designed to have an operating characteristic that is represented by the relationship of a displacement of a spool with respect to a change in the pilot pressure. In addition, the relationship assumes two stepped lines. Thus, an initial period of time in which the spool is displaced is represented by a seal width holding range. The seal width holding range is followed by a subsequent spool displacement range that is represented by a flow control range. Accordingly, not only can the fluid leakage be minimized but also a highly accurate flow rate control can be attained by the system.

While the present invention has been described with respect to certain illustrative embodiments, it will be obvious to a person skilled in the art that many alterations, omissions and additions can be made without departing from the essence and the scope of the present invention. Accordingly, it should be understood that the present invention is not limited to the specific embodiments set out above, but includes all possible embodiments that can be made within the scope with respect to the features specifically set forth in the appended claims and encompasses all equivalents thereof.

We claim:

1. A valve for controlling the flow of fluid in a cylinder, said valve comprising:

a valve body having a cylinder side mounting surface for use in mounting said valve to the cylinder, said cylinder side mounting surface having a cylinder port;

wherein said valve body has formed therein a directional control valve side passage, a cylinder side passage fluidically connected with said cylinder port, and a directional control valve port fluidically connected with said directional control valve side passage;

wherein a check valve is provided in said valve body such that a first plane intersects said check valve and wherein said check valve is operably connected with said directional control valve side passage and said cylinder side passage;

wherein a flow rate control valve is provided in said valve body such that said first plane intersects said flow rate control valve and wherein said flow rate control valve is operably connected with said directional control valve side passage and said cylinder side passage;

wherein a safety valve is provided in said valve body such that said first plane intersects said safety valve and wherein said safety valve is operably connected with said cylinder side passage; and wherein said first plane is substantially parallel to said cylinder side mounting surface.

2. A valve as recited in claim 1, wherein said check valve is operable to prevent a fluid from flowing into said directional control valve side passage from said cylinder side passage.

3. A valve as recited in claim 1, wherein said flow rate control valve is operable to block communication between said directional control valve side passage and said cylinder side passage, in the absence of an external signal, and to establish communication between said directional control valve side passage and said cylinder side passage, upon receiving an external signal.

4. A valve as recited in claim 1, wherein said safety valve is operable to relieve pressure in said cylinder side passage.

5. A valve as recited in claim 1, wherein said valve body has a spool bore formed therein; and wherein said flow rate control valve has a spool slidingly disposed in said spool bore between a blocking position and a communicating position, and a system of springs located in said valve body abutting said spool such that, in the absence of an application of a pilot pressure to said flow rate control valve, said spool assumes said blocking position, and such that, upon the application of a pilot pressure to said flow rate control valve, said spool assumes said communicating position.

6. A valve as recited in claim 5 further comprising:

a spring box mounted onto a side wall of said valve body;

wherein said system of springs includes a spring bearing, a first spring interposed between said spool and said spring bearing, and a second spring interposed between said spring bearing and said spring box;

wherein a spring constant of said second spring is greater than a spring constant of said first spring.

7. A valve as recited in claim 5, wherein said valve body has a communicating bore formed therein;

wherein said valve, in the absence of an application of a pilot pressure to said flow rate control valve, is operable to allow fluid to flow from said directional control valve side passage through said communicating bore into said cylinder side passage; and wherein said valve, upon the application of a pilot pressure to said flow rate control valve, is operable to allow fluid to flow said cylinder side passage through said spool bore into said directional control valve side passage.

8. A valve as recited in claim 1, wherein said valve body has a spool bore formed therein;

wherein said flow rate control valve has a spool, having a cone seat portion, slidingly disposed in said valve body for movement between a blocking position and a communicating position;

wherein said cone seat, when said spool assumes said blocking position, blocks communication between said directional control valve side passage and said cylinder side passage.

9. A valve as recited in claim 1, wherein said cylinder side passage and said directional control valve side passage each has a main axis which is substantially parallel to said first plane.

10. A valve as recited in claim 1, wherein said cylinder side passage, said check valve, and said flow rate control valve are arranged to allow fluid to flow from said cylinder side passage toward said cylinder port, and from said cylinder port toward said cylinder side passage.

11. A system comprising:

a cylinder having a chamber;

a valve body having a cylinder side mounting surface tangentially mounted on said cylinder, said cylinder side mounting surface having a cylinder port which is fluidically connected with said chamber;

wherein said valve body has formed therein a directional control valve side passage, a cylinder side passage fluidically connected with said cylinder port, and a directional control valve port fluidically connected with said directional control valve side passage;

wherein a check valve is provided in said valve body such that a first plane intersects said check valve and wherein said check valve is operably connected with said directional control valve side passage and said cylinder side passage;

wherein a flow rate control valve is provided in said valve body such that said first plane intersects said flow rate control valve and wherein said flow rate control valve is operably connected with said directional control valve side passage and said cylinder side passage; and wherein a safety valve is provided in said valve body such that said first plane intersects said check valve and wherein said safety valve is operably connected with said cylinder side passage;

wherein said first plane is substantially parallel to said cylinder side mounting surface.

12. A system as recited in claim 11, wherein said check valve is operable to prevent a fluid from flowing into said directional control valve side passage from said cylinder side passage.

13. A system as recited in claim 11, wherein said flow rate control valve is operable to block communication between said directional control valve side passage and said cylinder side passage, in the absence of an external signal, and to establish communication between said directional control valve side passage and said cylinder side passage, upon receiving an external signal.

14. A system as recited in claim 11, wherein said safety valve is operable to relieve pressure in said cylinder side passage.

15. A system as recited in claim 11, wherein said valve body has a spool bore formed therein; and wherein said flow rate control valve has a spool slidingly disposed in said spool bore between a blocking position and a communicating position, and a system of springs located in said valve body abutting said spool such that, in the absence of an application of a pilot pressure to said flow rate control valve, said spool assumes said blocking position, and such that, upon the application of a pilot pressure to said flow rate control valve, said spool assumes said communicating position.

16. A system as recited in claim 15 further comprising:

a spring box mounted onto a side wall of said valve body;

wherein said system of springs includes a spring bearing, a first spring interposed between said spool and said spring bearing, and a second spring interposed between said spring bearing and said spring box;

wherein a spring constant of said second spring is greater than a spring constant of said first spring.

17. A system as recited in claim 15, wherein said valve body has a communicating bore formed therein;

wherein said valve, in the absence of an application of a pilot pressure to said flow rate control valve, is operable to allow fluid to flow from said directional control valve side passage through said communicating bore into said cylinder side passage; and wherein said valve, upon the application of a pilot pressure to said flow rate control valve, is operable to allow fluid to flow from said cylinder side passage through said spool bore into said directional control valve side passage.

18. A system as recited in claim 11, wherein said valve body has a spool bore formed therein;

wherein said flow rate control valve has a spool, having a cone seat portion, slidingly disposed in said valve body for movement between a blocking position and a communicating position;

wherein said cone seat, when said spool assumes said blocking position, blocks communication between said directional control valve side passage and said cylinder side passage.

19. A system as recited in claim 11, wherein said cylinder side passage and said directional control valve side passage each has a main axis which is substantially parallel to said first plane.

20. A system as recited in claim 11, wherein said cylinder side passage, said check valve, and said flow rate control valve are arranged to allow fluid to flow from said cylinder side passage toward said cylinder port, and from said cylinder port toward said cylinder side passage.

* * * * *